United States Patent [19]

Larson

[11] Patent Number: 4,879,988

[45] Date of Patent: Nov. 14, 1989

[54] OVERDRAW SYSTEM FOR ARCHERY BOWS

[75] Inventor: Marlow W. Larson, Ogden, Utah

[73] Assignee: Browning, Morgan, Utah

[21] Appl. No.: 270,054

[22] Filed: Nov. 14, 1988

[51] Int. Cl.[4] ..... F41B 5/00

[52] U.S. Cl. ..... 124/41 A; 124/88

[58] Field of Search ..... 124/41 A, 23 R, 26, 124/88, DIG. 1

[56] References Cited

U.S. PATENT DOCUMENTS

| | | | |
|---|---|---|---|
| 2,777,435 | 1/1957 | Brooks | 124/44.5 |
| 4,407,261 | 10/1983 | Elliott | 124/44.5 |
| 4,662,346 | 5/1987 | Laffin | 124/44.5 |
| 4,759,337 | 7/1988 | Suski | 124/44.5 |

OTHER PUBLICATIONS

Martin Archery, Inc. Advertisement, Archery World, Apr. 1988, p. 2.

Martin Archery, Inc., Catalog, Jun. 1988.

Bowhunters Warehouse Catalog, Jun. 1988, p. 37.

*Primary Examiner*—Randolph A. Reese

*Assistant Examiner*—Anthony Knight

*Attorney, Agent, or Firm*—Trask, Britt & Rossa

[57] ABSTRACT

An overdraw system for an archery bow incorporates a three-point connection to the handle riser of the bow. All components of the system are configurated to permit assembly into either left-handed or right-handed versions. An arrow enclosure mounts a cantilevered, spring-biased toggle arm above and transverse an arrow shaft position within the system.

19 Claims, 3 Drawing Sheets

OVERDRAW SYSTEM FOR ARCHERY BOWS

BACKGROUND OF THE INVENTION

1. Field

This invention relates to archery bows and is directed to an overdraw system for such bows. It is particularly directed to an improved overdraw system which provides greater stability of mounting onto a handle riser and improved versatility for use with both left- and right-handed handle risers.

2. State of the Art

Ordinarily an archer must select an arrow sufficiently long to prevent the tip or arrow point from being drawn back beyond the handle riser of the bow when the archer has drawn the bowstring to full draw. It is sometimes desired, particularly for precision target shooting, to draw the bow beyond the normal full draw position of the archer. For example, it may be desired to use an arrow of a predetermined length and weight. In that event, pulling a bow to its designed full draw condition or the archer's normal full draw length, can result in pulling the arrow point beyond the handle riser. Various support mechanisms, typically called overdraw systems, have been designed to support the arrow point under these overdrawn conditions. Currently available overdraw systems are confronted with a number of problems, particularly in the field. It is essential that such systems be rigidly and reliably mounted to the handle riser of the bow. Currently available overdraw systems typically become dislodged or misaligned during use. Considerable risk of injury rises when an arrow is pulled back to an overdrawn position. It is essential that adequate protection be afforded an archer during the period when the arrow is overdrawn. It is particularly important that the arrow be retained in some fashion so that it cannot slip away from the overdraw system. A loose arrow in overdrawn condition lacks the support normally provided by a handle riser. Currently available overdraw systems have been unsatisfactory in this respect.

SUMMARY OF THE INVENTION

The present invention provides an overdraw system for archery bows with a substantially improved mounting system. This system may be embodied in various configurations but in any event provides a stable three-point connection of the overdraw system to the handle riser of a bow.

The overdraw system of this invention may be constructed and assembled in a fashion which permits maximum versatility from the standpoint of its merchandising or adaptability to various archery bows in the field. The system may be constructed to permit reassembly into either left- or right-handed versions. In either case, it may carry arrow rest devices of the fashion typically required for overdraw systems.

Many other features may be included in the overdraw system of this invention For example, it is possible to provide a removable side guard to increase the safety to the archer under certain circumstances. It is also within contemplation that a removable side guard may be utilized with both left- and right-hand versions.

The overdraw system includes a mounting support structure which carries components cooperatively adapted to provide the firm three-point mounting attachment which distinguishes the system of this invention from prior art devices. These components are associated with a first portion of the mounting support structure which may be regarded as a mounting element adapted to couple with the handle riser. Extending from this mounting element is a support extension which serves to support the remaining structure of the system and to provide a mounting base for auxiliary components, such as an arrow rest or arrow retaining device. Ideally, the mounting support structure is symmetrical about its longitudinal axis so that it may be rotated from a position suitable for mounting against the handle riser of a left-handed archery bow 180° into a position suitable for mounting adjacent the handle riser of a right-handed archery bow. As so configurated, the mounting support structure is provided with suitable fixtures, such as tapped holes, to accommodate other portions of the overdraw system as well as ancillary devices, without regard to its rotated position.

The support extension of the mounting support structure carries an overdraw frame. With the mounting support structure fixed to a handle riser so that its longitudinal axis is approximately transverse the riser, the overdraw frame is typically suspended from the support extension by connection to the lowermost mounting surface of that extension. The frame will include a bottom and a side guard upstanding from the bottom. The bottom and side guard are held in relation to the support extension to cooperatively define a panel or trough which contains the point of an arrow when the arrow is pulled back to an overdrawn condition.

According to some embodiments, an arrow retaining device is mounted in association with the overdraw frame to prevent rising of the arrow out of the retaining channel.

Maximum adaptability for mounting arrow rests and other auxiliary devices of varying design may be provided in the form of a reversible accessory insert carried by the support extension. Arrow rests, for example, are available in various configurations and are sold for mounting on overdraw systems of various specific designs. Accordingly, interchangeability of commercially available arrow rests has generally been impracticable. The reversible insert contemplated by this invention affords the opportunity to provide a tapped mounting hole appropriately located to accommodate and properly position arrow rests of widely varying design.

In the preferred embodiments of this invention, it is contemplated that the mounting support structure, the overdraw frame, and the side guard extension all be structured so that they may be assembled into either a left-hand or right-hand configuration. To facilitate such reversibility, it is preferred that the mounting support bottom of the overdraw frame and the side guard extension all be approximately symmetrical with respect to their longitudinal axes. The bottom of the overdraw frame is provided with an open portion or accessory window at the end of the overdraw frame furthest (or most remote) from the handle riser. This accessory window is advantageous for the mounting of an arrow rest to hold the arrow shaft appropriately within the trough defined by the overdraw frame and support extension. To preserve the reversibility of the overdraw frame, it is necessary to provide such a window at each end of the bottom of the overdraw frame. In practice, the accessory window which is not in use, that is, the open portion in the proximity of the handle riser, is filled with a removable base plate.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
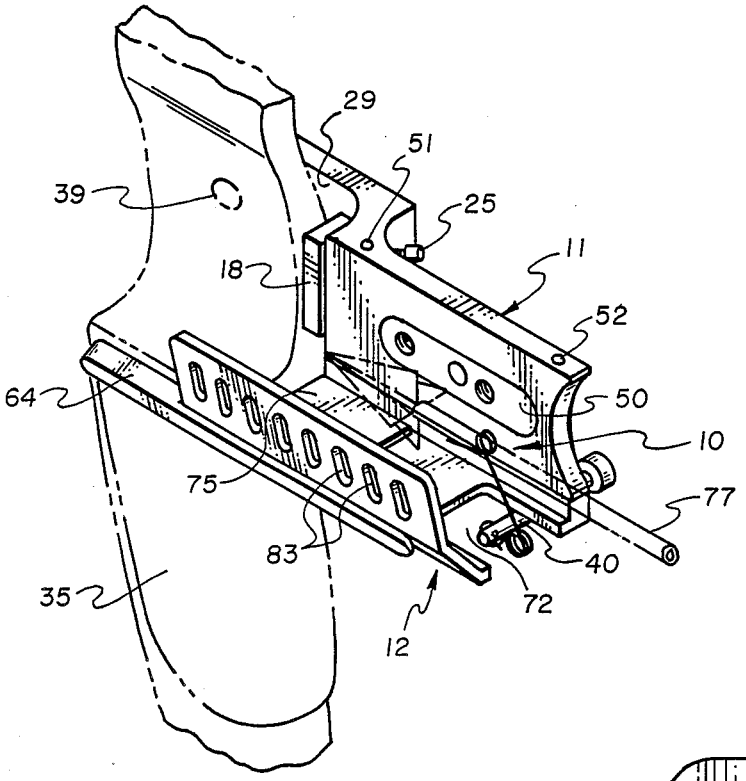
FIG. 1 is a view in perspective of the overdraw system of this invention fully assembled, mounted to a handle riser of an archery bow, the handle riser being shown in fragmentary phantom section.
Figure 6:
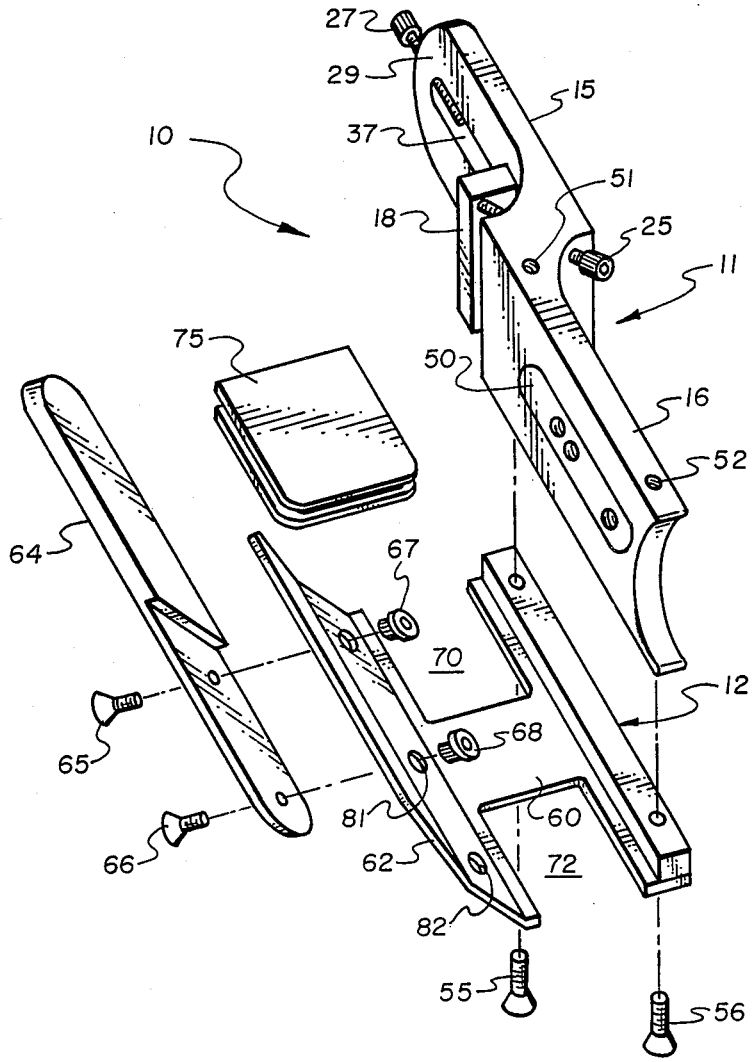
FIG. 6 is an exploded view of the components of the overdraw system illustrated by FIG. 1 with the individual components shown in perspective.

As best illustrated by FIGS. 1 and 6, the overdraw system of this invention, designated generally 10, comprises as basic components, a mounting support structure designated generally 11 and an overdraw frame designated generally 12. The mounting support structure 11 includes two basic components: a mounting element 15 and a support extension 16, respectively. As illustrated, the mounting element 15 and support extension 16 are the principal portions of a unitary mounting support which carries ancillary mounting elements; namely, a movable block 18, a mounting bolt 20 (see FIGS. 3 and 4), and adjustment bolts 24, 25 and 27.

The movable block 18 is held in position against the interface surface 29 of the mounting element 15 by means of a bolt 30 which is free to slide in a slot 31. The interface surface 29 is the surface which abuts against the handle riser 35 (FIG. 1) when the overdraw system of this invention is attached to an archery bow. When so installed, the mounting bolt 20 passes through the slot 37 to engage one of the mounting inserts 39 conventionally provided on archery riser handles.

Figure 7:
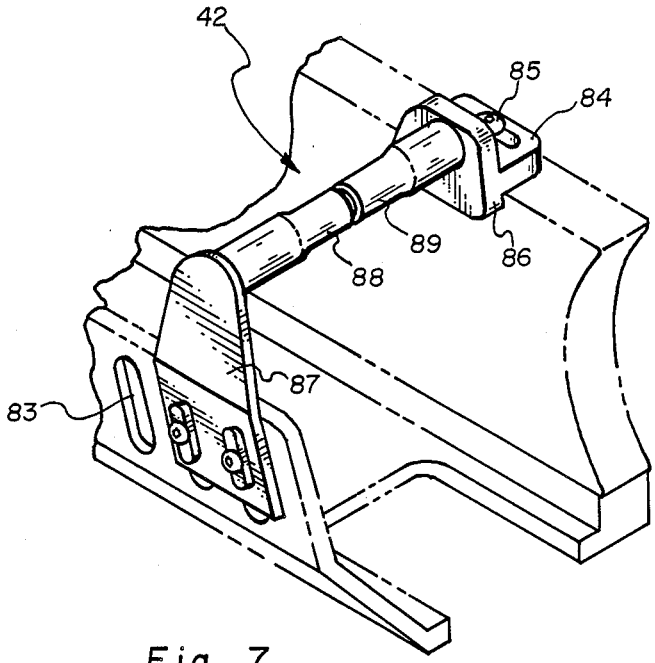
FIG. 7 shows a segment of the overdraw system illustrated by FIG. 1 carrying an additional arrow retaining device.
Figure 8:
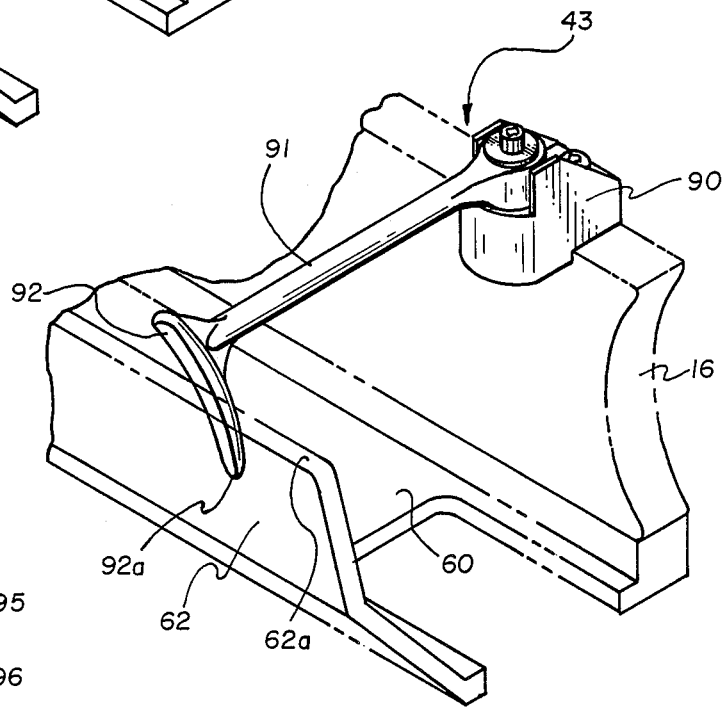
FIG. 8 is a view similar to FIG. 7, illustrating an alternative arrow retaining device.

The support extension 16 is adapted to carry the overdraw frame 12 and other devices such as the arrow rest 40 (FIG. 1) or the arrow retaining devices 42, 43 illustrated in FIGS. 7 and 8. Such accessories are mounted, for example, by attachment screws turned into the threaded holes 45, 46, 47 of the insert 50 or the tapped holes 51, 52 illustrated at the visible surface of the support extension 16. In the embodiment illustrated in FIG. 6, holes corresponding to the tapped holes 51, 52 are provided on the surface opposite the visible surface of the extension 16 to receive the bolts 55, 56.

Figure 5:
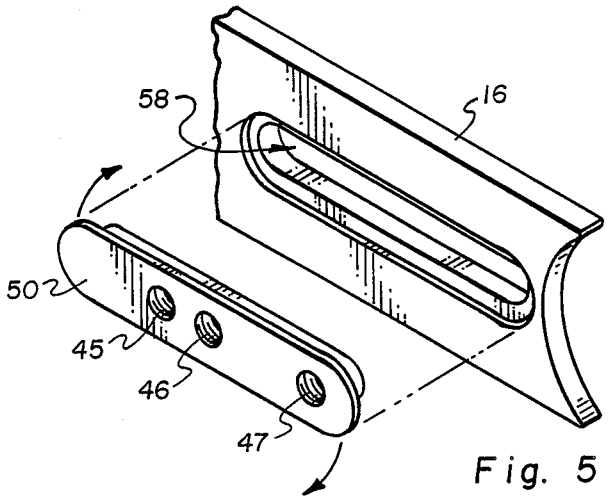
FIG. 5 is a view in perspective showing a portion of the overdraw system illustrated by FIG. 1 illustrating a reversible accessory insert.

As can be seen from FIG. 5, the insert 50 may be rotated 180° and reinserted into the aperture 58 to reposition the holes 45, 46, 47, affording a selection of five different tapped hole locations. (The hole 46 is exactly centered and maintains its position in both rotated positions of the insert 50).

The mounting bolts 55 and 56 clamp the overdraw frame 12 to the lower surface of the support extension 16 in the configuration illustrated by FIG. 1. The frame 12 includes a bottom element 60 and a side rail element 62. These elements 60, 62 are illustrated as one integral piece. A side guard extension 64 is removably fastened to the side guard 62 by means of the screws 65, 66 and corresponding inserts 67, 68. Again, the side extension 64 is illustrated in its mounted condition by FIG. 1. The overdraw frame bottom 60 includes two openings 70, 72, the first of which (in the orientation illustrated) is proximate the mounting element 15 (FIG. 6) and the handle riser 35 (FIG. 1). The second such opening 72 is located remote from the handle riser 35 to function as a accessory window to receive the arrow rest 40. A removable plate 75 is adapted to couple with the bottom 60 selectively to fill either the opening 70 or the opening 72, whichever happens to be located proximate the handle riser 35, as illustrated in FIG. 1.

It will be noted that all of the major structural components of the overdraw system, specifically the mounting support 11 and its components, the mounting element 15 and support extension 16, the overdraw frame 12 and its components, the floor 60 and side guard 62, as well as the side guard extension 64, have longitudinal axes approximately parallel the arrow position illustrated by the arrow 77 (shown in phantom in FIG. 1); that is, approximately transverse the handle riser when the overdraw system is mounted to the handle riser as shown in FIG. 1. It is preferred that the support structure 11, floor 60 and side guard extension 64 each be approximately symmetrical about their central longitudinal axes to facilitate the ready conversion of the overdraw system between left-handed and right-handed versions.

Considering the overdraw system as illustrated by FIG. 1 to be a right-handed version that is suitable for use by a right-handed archer, the system may be converted to a left-handed version by removing the side guard extension 64 and the overdraw frame 12 from their assembled condition. The sliding plate 75 is then removed from the opening 70. The support structure 11 is rotated 180° around its longitudinal axis from the position illustrated in FIG. 6. The arrow overdraw frame 12 is rotated 180° about an axis transverse its longitudinal axis from the position illustrated in FIG. 6. It is then connected by the bolts 55, 56 into the tapped holes 51, 52. The sliding plate 75 is then inserted into the open portion 72, and the side guard extension 64 may be reinstalled using the holes 81 and 82 with the side guard rotated 180° about an axis transverse its longitudinal axis from the position shown in FIG. 6.

Figure 2:
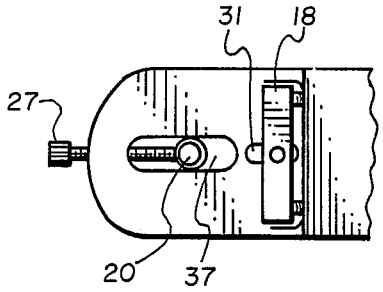
FIG. 2 is a side elevation of a portion of the overdraw system hidden from view in FIG. 1 illustrating details of the mounting system.
Figure 3:
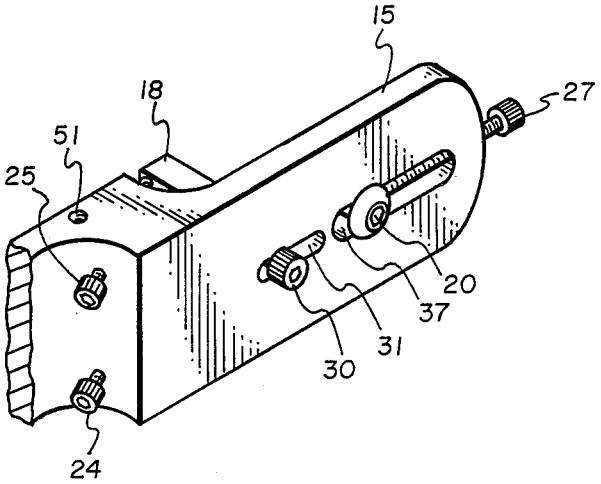
FIG. 3 is a fragmentary view in perspective showing the details of the mounting system illustrated by FIG. 2.
Figure 4:
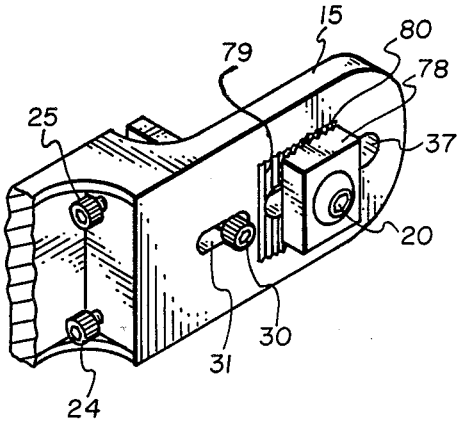
FIG. 4 is a view similar to FIG. 3 illustrating an alternative locking mechanism.

FIGS. 2 and 3 illustrate a preferred three-point mounting system for the overdraw system of this invention. The mounting bolt 20 clamps the mounting element 15 flush against the surface of the handle riser 35 as illustrated in FIG. 1. The bolt 27 is turned to draw the overdraw frame up towards the handle riser until it is snug. The screws 24 and 25 are then turned to urge the movable block 18 against the handle riser as can be seen in FIG. 1, thereby effecting a rigid three-point connection. It is within contemplation to rely upon the bolts 24 and 25 to effect minor adjustments to the horizontal orientation of support structure 11.

As an alternative, a serrated block 78 in cooperation with a serrated area 79 on the outer surface of the mounting element 15 may be used in place of the bolt 27. According to this embodiment, the longitudinal positioning of the overdraw frame 12 with respect to the riser 35 is set by positioning the block 78 as desired with respect to the slot 37. When the bolt 20 is turned to clamp the mounting element 15 flush against the riser 35, the serrations 80 of the block 78 mesh with the serrations of the area 79 to effect a tight no-slip coupling. Serrations of approximately 0.02 pitch provide good results for this application.

Figure 9:
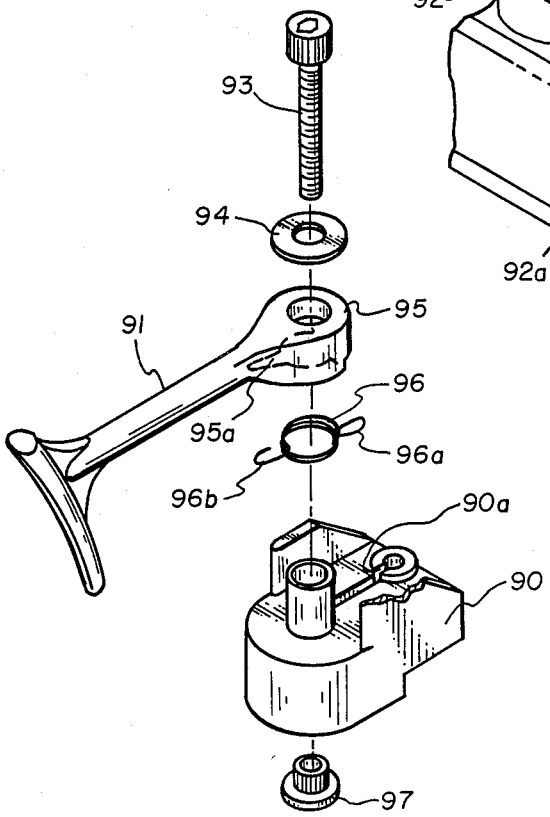
FIG. 9 is an exploded view showing the components of the arrow retaining device illustrated by FIG. 8.

FIGS. 7, 8 and 9 illustrate an additional refinement to the overdraw system of this invention. Either by utilizing the accessory insert or the tapped holes 51 and 52 or mounting holes 82 provided by the overdraw system components, arrow retaining devices such as the specific devices 42, 43 illustrated or others currently available can be mounted to form a arrow enclosure which totally restrains the arrow from movement from the overdraw channel when it is in its overdrawn condition.

The arrow enclosure device 42 illustrated by FIG. 7 comprises a first base element 84 attached by means of a screw 85 to the threaded hole 52. A depending lip 86 bears against the inner surface of the mounting extension 16 to hold the element 84 in position. An upstanding support element 87 is connected to mounting holes 83 in the side guard 62. Two resilient arms 88, 89 are cantilevered as shown so that an arrow shaft may be forced down between their distal ends when the arrow is being loaded preparatory to drawing it back for a shot.

A preferred arrow enclosure is illustrated by FIGS. 8 and 9. A base 90 is mounted as described in connection with the base 84 and carries a cantilevered spring-biased toggle arm 91 suspended over the top of the trough defined by the support extension 16, floor 60, and side guard 62. A curved depending gate element 92 is carried by the distal end of the toggle arm 91. The toggle arm 91 may be moved or pivoted aside by the gentle pressure of an arrow shaft against the gate 92, thereby permitting entry of the arrow shaft into the trough. The components of the toggle system are illustrated by FIG. 9, whereby it may be seen that an assembly includes the bolt 93, washer 94, toggle arm 91 with its associated pivot base 95, the spring 96 and the base 90 held together by the turning of the threaded bolt 93 into the insert 97. One end 96A of the spring 96 is retained by the slot 90A of the base 90 while the other end 96B of the spring 96 is retained within the slot 95A of the pivot base 95. The lowermost tip 92A of the gate 92 is of appropriate elevation to just pass the upper edge 62A of the side guard 62 when it is swung across the edge 62A in response to pressure by an arrow shaft. Once the arrow has entered the guide and the gate is released, it swings back into the position illustrated by FIG. 8, thereby serving to prevent lifting of the arrow shaft out of the trough.

The arrow enclosure of FIGS. 8 and 9 is adaptable to the overdraw system assembled in either its left-handed or right-handed versions. The toggle arm 91 may be pivoted in either direction away from its normal central biased position.

Reference herein to specific details of the illustrated embodiments is not intended to limit the scope of the appended claims which themselves set forth those features regarded as essential or important to the invention.

What is claimed is:

1. An overdraw system for archery bows having a handle riser with accessory inserts, comprising:

a mounting support structure with a longitudinal axis, said structure including:

a mounting element adapted to couple with said handle riser of an archery bow and a support extension;

an overdraw frame carried by said support extension including a bottom element with an open portion constituting an accessory window and a side guard element approximately parallel said mounting support so that said overdraw frame and mounting support cooperatively define a retaining channel; and a locking system associated with said mounting element including a mounting bolt in mounting relationship with an accessory insert carried by said handle riser, thereby to hold said mounting element against said handle riser with said longitudinal axis approximately transverse said handle riser, first means for holding said mounting element in a selected position along said longitudinal axis and second means for urging said mounting element in a direction away from said selected position.

2. An overdraw system according to claim 1 wherein said first means comprises a pressure block mounted on said mounting bolt in position to clamp said mounting element between said handle riser and said block.

3. An overdraw system according to claim 2 wherein the interface between said block and said mounting element comprises interlocking serrations carried on the surfaces of said block and said mounting element, respectively.

4. An overdraw system according to claim 3 wherein said mounting element carries a longitudinal slot to receive said mounting bolt, and the surface of said mounting element in the vicinity of said slot is serrated in an area larger in the longitudinal direction than the serrated surface of said block, thereby permitting longitudinal adjustment of the position of said interface.

5. An overdraw system according to claim 1 wherein said first means is an adjustable mechanism adapted to press against said mounting bolt, thereby to resist movement of said mounting element by said second means in said selected longitudinal direction.

6. An overdraw system according to claim 5 wherein said adjustable mechanism comprises a bolt threaded into said mounting element approximately traverse said mounting bolt.

7. An overdraw system according to claim 1 wherein said second means comprises a movable element positioned against said handle riser and means for urging said movable element against said riser.

8. An overdraw system according to claim 1 wherein said support extension carries support means for attachment of an arrow rest device.

9. An overdraw system according to claim 8 wherein said support means comprises a removable insert with tapped holes adapted to receive attachment means.

10. An overdraw system according to claim 9 wherein said removable insert is mounted within a slot in said support extension and said insert and said slot are cooperatively configurated so that said insert may be removed from said slot, rotated 180° and reinserted in said slot.

11. An overdraw system according to claim 1, including an arrow retaining device mounted in association with said mounting support structure, said device including an arm positioned transverse and above said retaining channel.

12. An overdraw system according to claim 11 wherein said device comprises: a first base element attached to said support structure on one side of said channel, a second base element attached to said support structure on the opposite side of said channel and resilient arms cantilevered by each of said base elements with the distal ends of said arms juxtaposed in close proximity to each other.

13. An overdraw system according to claim 11 wherein said device comprises a base element mounted to said support structure, said base element carrying a cantilevered spring-biased toggle arm suspended over the open top of said retaining channel, a gate element carried by the distal end of said toggle arm, said toggle arm and gate together forming an enclosure with said channel; said gate constituting means for contact by the shaft of an arrow, thereby to pivot said toggle arm from its normal position to permit entry of said arrow shaft into said channel.

14. An overdraw system for archery bows having a handle riser with accessory inserts, comprising:

a mounting support structure with a longitudinal axis, said structure including:

a mounting element adapted to couple with said handle riser of an archery bow and a support extension;

an overdraw frame carried by said support extension including a bottom element with an open portion constituting an accessory window and a side guard element approximately parallel said mounting support so that said overdraw frame and mounting support cooperatively define a retaining channel;

a locking system releasably connecting said mounting element to the handle riser of said bow; and a removable side guard extension with a longitudinal axis, said extension including a first portion adapted for attachment to said side guard and a second portion oriented to extend approximately parallel said mounting element adjacent said handle riser.

15. An overdraw system for archery bows having a handle riser with accessory inserts, comprising:

a mounting support structure with a longitudinal axis, said structure including:

a mounting element adapted to couple with said handle riser of an archery bow and a support extension;

an overdraw frame carried by said support extension including a bottom element with an open portion constituting an accessory window and a side guard element approximately parallel said mounting support so that said overdraw frame and mounting support cooperatively define a retaining channel; and a removable base plate element sized and configurated to mate releasably with and fill said open portion.

16. An overdraw system according to claim 15 wherein said bottom element includes first and second substantially similar open portions located at opposite ends of said bottom element, and said base plate element is adapted selectively for mating with either of said open portions.

17. An overdraw system according to claim 16 wherein said mounting support and overdraw frame are detachable from each other, said support extension has a first surface in a plane approximately transverse said handle riser and a second surface in a plane approximately parallel said first surface, each of said first and second surfaces being adapted to mate with said overdraw frame, and including means for connecting said overdraw frame to said support extension selectively at either of said first and second surfaces and with said overdraw frame selectively rotated to position either said first or said second open portions remote from said handle riser.

18. An overdraw system according to claim 17 further including:

a removable side guard extension with a longitudinal axis, said extension including a first portion adapted for attachment to said side guard and a second portion oriented to extend approximately parallel said mounting element adjacent said handle riser;

wherein said side guard extension is approximately symmetrical about its said longitudinal axis and said side guard and said side guard extension are mutually adapted to enable attachment of said first portion of said extension to said side guard in either a first portion or a second position wherein said extension is rotated 180° with respect to said first position.

19. An overdraw system comprising:

an arrow enclosure having:

a base with a bottom and a top;

a cantilevered spring-biased toggle arm cantilevered from the top of said base and pivotally mounted thereto on an axis;

a curved, depending gate element carried by the distal end of said toggle arm; and biasing means for holding said toggle arm in a normal central orientation, but adapted to permit pivoting of said arm in either direction about said axis from said normal central orientation;

said base being positioned upon mounting support structure adapted to couple with the handle riser of an archery bow.

* * * * *